US005625961A

United States Patent [19]

Ensign et al.

[11] Patent Number: 5,625,961

[45] Date of Patent: May 6, 1997

[54] MULTIPLE ZONE LIMITING ORIFICE DRYING OF CELLULOSIC FIBROUS STRUCTURES, APPARATUS THEREFOR, AND CELLULOSIC FIBROUS STRUCTURES PRODUCED THEREBY

[75] Inventors: Donald E. Ensign, Cincinnati; Michael G. Stelljes, Jr., West Chester; Paul D. Trokhan, Hamilton, all of Ohio

[73] Assignee: The Procter & Gamble Company, Cincinnati, Ohio

[21] Appl. No.: 658,045

[22] Filed: Jun. 4, 1996

Related U.S. Application Data

[62] Division of Ser. No. 486,874, Jun. 7, 1995.

[51] Int. Cl.[6] ..... F26B 11/02

[52] U.S. Cl. ..... 34/117; 34/114; 34/115; 34/116

[58] Field of Search ..... 34/114, 115, 116, 34/117, 120, 121, 122

[56] References Cited

U.S. PATENT DOCUMENTS

| | | | |
|---|---|---|---|
| Re. 28,459 | 7/1975 | Cole et al. | 34/6 |
| 4,172,910 | 10/1979 | Rotar | 427/243 |
| 4,251,928 | 2/1981 | Rotar et al. | 34/116 |
| 4,329,201 | 5/1982 | Bolton | 162/198 |
| 4,528,239 | 7/1985 | Trokhan | 428/247 |
| 4,556,450 | 12/1985 | Chuang et al. | 162/204 |
| 4,583,302 | 4/1986 | Smith | 34/116 |
| 4,888,096 | 12/1989 | Cowan et al. | 162/358 |
| 4,921,750 | 5/1990 | Todd | 428/225 |
| 4,932,138 | 6/1990 | Liedes et al. | 34/23 |
| 4,942,675 | 7/1990 | Sundovist | 34/23 |
| 4,973,385 | 11/1990 | Jean et al. | 162/368 |
| 5,020,242 | 6/1991 | Mayer et al. | 34/115 |
| 5,274,930 | 1/1994 | Ensign et al. | 34/23 |
| 5,437,107 | 8/1995 | Ensign et al. | 34/117 |

*Primary Examiner*—Henry A. Bennett
*Assistant Examiner*—Dinnatia Doster
*Attorney, Agent, or Firm*—Larry L. Huston; E. Kelly Linman; Jacobus C. Rasser

[57] ABSTRACT

A limiting orifice through-air-drying apparatus for papermaking or other absorbent embryonic webs. The apparatus has a first zone and a second zone. The first zone is maintained at a differential pressure less than the breakthrough pressure, while the second zone is maintained at a differential pressure greater than the breakthrough pressure. The residence time of the embryonic web to be dried with the apparatus is maintained at preferably less than 35 milliseconds on the first zone. Using the dual zone system described above, the overall energy required to run the apparatus can be reduced.

12 Claims, 1 Drawing Sheet

MULTIPLE ZONE LIMITING ORIFICE DRYING OF CELLULOSIC FIBROUS STRUCTURES, APPARATUS THEREFOR, AND CELLULOSIC FIBROUS STRUCTURES PRODUCED THEREBY

This is a divisional of application Ser. No. 08/486,874, filed on Jun. 7, 1995.

FIELD OF THE INVENTION

The present invention relates to absorbent embryonic webs which are through air dried, and particularly to cellulosic fibrous structures which are through air dried.

BACKGROUND OF THE INVENTION

Absorbent embryonic webs are a staple of everyday life. Absorbent embryonic webs include cellulosic fibrous structures, absorbent foams, etc. Cellulosic fibrous structures have become a staple of everyday life. Cellulosic fibrous structures are found in facial tissues, toilet tissues and paper toweling.

In the manufacture of cellulosic fibrous structures, a wet embryonic web of cellulosic fibers dispersed in a liquid carrier is deposited onto a forming wire. The wet embryonic web may be dried by any one of or combinations of several known means, each of which drying means will affect the properties of the resulting cellulosic fibrous structure. For example, the drying means and process can influence the softness, caliper, tensile strength, and absorbency of the resulting cellulosic fibrous structure. Also the means and process used to dry the cellulosic fibrous structure affects the rate at which it can be manufactured, without being rate limited by such drying means and process.

An example of one drying means is felt belts. Felt drying belts have long been used to dewater an embryonic cellulosic fibrous structure through capillary flow of the liquid carrier into a permeable felt medium held in contact with the embryonic web. However, dewatering a cellulosic fibrous structure into and by using a felt belt results in overall uniform compression and compaction of the embryonic cellulosic fibrous structure web to be dried.

Felt belt drying may be assisted by a vacuum, or may be assisted by opposed press rolls. The press rolls maximize the mechanical compression of the felt against the cellulosic fibrous structure. Examples of felt belt drying are illustrated in U.S. Pat. No. 4,329,201 issued May 11, 1982 to Bolton and U.S. Pat. No. 4,888,096 issued Dec. 19, 1989 to Cowan et al.

Drying cellulosic fibrous structures through vacuum dewatering, without the aid of felt belts is known in the art. Vacuum dewatering of the cellulosic fibrous structure mechanically removes moisture from the cellulosic fibrous structure while the moisture is in the liquid form. Furthermore, the vacuum deflects discrete regions of the cellulosic fibrous structure into the deflection conduits of the drying belts and strongly contributes to having different amounts of moisture in the various regions of the cellulosic fibrous structure. Similarly, drying a cellulosic fibrous structure through a vacuum assisted capillary flow, using a porous cylinder having preferential pore sizes is known in the an as well. Examples of such vacuum driven drying techniques are illustrated in commonly assigned U.S. Pat. No. 4,556,450 issued Dec. 3, 1985 to Chuang et at. and U.S. Pat. No. 4,973,385 issued Nov. 27, 1990 to Jean et al.

In yet another drying process, considerable success has been achieved drying the embryonic web of a cellulosic fibrous structure by through-air drying. In a typical through-air drying process, a foraminous air permeable belt supports the embryonic web to be dried. Hot air flow passes through the cellulosic fibrous structure, then through the permeable belt or vice versa. The air flow principally dries the embryonic web by evaporation. Regions coincident with and deflected into the foramina in the air permeable belt are preferentially dried and the caliper of the resulting cellulosic fibrous structure increased. Regions coincident the knuckles in the air permeable belt are dried to a lesser extent.

Several improvements to the air permeable belts used in through-air drying have been accomplished in the art. For example, the air permeable belt may be made with a high open area (at least forty percent). Or, the belt may be made to have reduced air permeability. Reduced air permeability may be accomplished by applying a resinous mixture to obturate the interstices between woven yarns in the belt. The drying belt may be impregnated with metallic particles to increase its thermal conductivity and reduce its emissivity or, alternatively, the drying belt may be constructed from a photosensitive resin comprising a continuous network. The drying belt may be specially adapted for high temperature airflows, of up to about 815 degrees C. (1500 degrees F.). Examples or such through-air drying technology are found in U.S. Pat. No. Reissue 28,459 reissued Jul. 1, 1975 to Cole et al.; U.S. Pat. No. 4,172,910 issued Oct. 30, 1979 to Rotar; U.S. Pat. No. 4,251,928 issued Feb. 24, 1981 to Rotar et al.; commonly assigned U.S. Pat. No. 4,528,239 issued Jul. 9, 1985 to Trokhan; and U.S. Pat. No. 4,921,150 issued May 1, 1990 to Todd. Additionally, several attempts have been made in the art to regulate the drying profile of the cellulosic fibrous structure while it is still an embryonic web to be dried. Such attempts may use either the drying belt, or an infrared dryer in combination with a Yankee hood. Examples of profiled drying are illustrated in U.S. Pat. No. 4,583,302 issued Apr. 22, 1986 to Smith and U.S. Pat. No. 4,942,675 issued Jul. 24, 1990 to Sundovist.

The foregoing art, even that specifically addressed to through-air drying, does not address the problems encountered when drying a multi-region cellulosic fibrous structure. For example, a first region of the cellulosic fibrous structure, having a lesser absolute moisture, density or basis weight than a second region, will typically have relatively greater airflow therethrough than the second region. This relatively greater airflow occurs because the first region of lesser absolute moisture, density or basis weight presents a proportionately lesser flow resistance to the air passing through such region.

This problem is exacerbated when the multi-region cellulosic fibrous structure to be dried is transferred to a Yankee drying drum. On a Yankee drying drum, isolated discrete regions of the cellulosic fibrous structure are in intimate contact with the circumference of a heated cylinder and hot air from a hood is introduced to the surface of the cellulosic fibrous structure opposite the heated cylinder. However, typically the most intimate contact with the Yankee drying drum occurs at the high density or high basis weight regions, which are not as dry as the low density or low basis weight regions. Preferential drying of the low density regions occurs by convective transfer of the heat from the airflow in the Yankee drying drum hood. Accordingly, the production rate of the cellulosic fibrous structure must be slowed, to compensate for the greater moisture in the high density or high basis weight region. To allow complete drying of the high density and high basis weight regions of the cellulosic fibrous structure to occur and to prevent scorching or burning of the already dried low density or low basis weight regions by the air from the hood, the Yankee hood air temperature must be decreased and the residence time of the cellulosic fibrous structure in the Yankee hood must be increased, slowing the production rate.

Another drawback to the approaches in the prior art (except those that use mechanical compression, such as felt belts) is that each relies upon supporting the cellulosic fibrous structure to be dried. Airflow is directed towards the cellulosic fibrous structure and is transferred through the supporting bell or, alternatively, flows through the drying belt to the cellulosic fibrous structure. Differences in flow resistance through the belt or through the cellulosic fibrous structure, amplify differences in moisture distribution within the cellulosic fibrous structure, and/or creates differences in moisture distribution where none previously existed. However, no attempt has been made in the an to tailor the airflow to the differences in various regions of the cellulosic fibrous structure.

One improvement in the an which addresses this problem is illustrated by commonly assigned U.S. Pat. No. 5,274,930 issued Jan. 4, 1994 to Ensign et al. and disclosing limiting orifice drying of cellulosic fibrous structures in conjunction with through-air drying, which patent is incorporated herein by reference. This patent teaches an apparatus utilizing a micropore drying medium which has a greater flow resistance than the interstices between the fibers of the cellulosic fibrous structure. The micropore medium is therefore the limiting orifice in the through-air drying process so that an equal, or at best a more uniform, moisture distribution is achieved in the drying process.

The limiting orifice through-air-drying apparatus of the Ensign et al. patent teaches having one or more zones with either a subatmospheric pressure or a positive pressure to promote airflow in either direction.

However, this patent (8: 17–26) also teaches that as the basis weight of the embryonic web increased, greater residence time on the micropore medium would be necessary, as logic would dictate. Specifically, it taught a common tissue paper basis weight (12 pounds per 3,000 square feet) would require a residence time of at least about 250 milliseconds on the micropore medium.

Applicants have unexpectedly found that the necessary residence time in the first zone can be reduced, providing the limiting orifice through-air drying apparatus is divided into plural zones. Furthermore, it has unexpectedly been found that the overall energy consumption of the apparatus can be reduced utilizing proper zones. Specifically, less fan horsepower is required if the zones are properly sized and selected. Fan horsepower reductions of up to 10 to 15 percent over the original apparatus disclosed in the aforementioned Ensign et al. patent can be by utilizing the present invention. At an advertised annual operating cost of $200 to $250 per horsepower per year the potential savings can be significant.

Accordingly, it is an object of this invention to provide a limiting orifice through-air drying apparatus having a micropore medium which can be used in conjunction with through-air drying to produce cellulosic fibrous structures. It is, furthermore, an object of this invention to provide a limiting orifice through-air drying apparatus which reduces the necessary residence time and requires less energy than had previously been thought in the prior art.

SUMMARY OF THE INVENTION

The invention comprises a limiting orifice through-air-drying apparatus in combination with an absorbent embryonic web having moisture distributed therein. The embryonic web may comprise a cellulosic fibrous structure. The embryonic web may have a consistency of at least 18 percent. The apparatus comprises a limiting orifice for airflow through the embryonic web. The apparatus further comprises a plurality of distinct zones, in order, at least a first zone and a second zone. The zones have mutually different differential pressures relative to the atmospheric pressure.

In one embodiment, the apparatus has a water removal rate in the second zone of at least 5 pounds of water per pound of embryonic web per second. In a second embodiment the apparatus has a water removal rate in the second zone at least 0.10 times as great as the water removal rate in the first zone, while the water removal rate in the second zone is at least 5 pounds of water per pound of embryonic web per second. In a third embodiment, the apparatus has a residence time in the first zone of less than about 35 milliseconds.

DETAILED DESCRIPTION OF THE INVENTION

Figure 1:
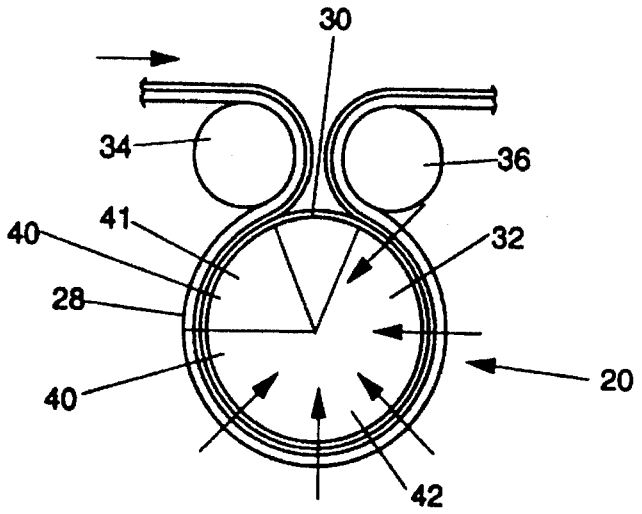
FIG. 1 is a schematic side elevational view of a micropore medium according to the present invention embodied on a pervious cylinder and having a subatmospheric internal pressure.

Referring to FIG. 1, the present invention comprises a limiting orifice though-air-drying apparatus 20 in conjunction with a micropore medium 30. The apparatus 20 and medium 30 may be made according to the aforementioned U.S. Pat. No. 5,274,930, the disclosure of which is incorporated herein by reference. The apparatus 20 comprises a pervious cylinder 32 and the micropore medium 30 circumscribing such a pervious cylinder 32. A support member 28, such as a through-air-drying belt, wraps the pervious cylinder 32 from an inlet roll 34 to a takeoff roll 36, subtending an arc defining a circular segment 40. This circular segment 40 may be subdivided into multiple zones 41, 42 having mutually different differential pressures relative to the atmospheric pressure. Alternatively, the apparatus 20 may comprise a partitioned vacuum slot or an endless belt. The apparatus 20 removes moisture from an embryonic web.

The limiting orifice through-air-drying apparatus 20 according to the present invention may particularly be divided into a plurality of zones. A preferred apparatus 20 has two zones, a first zone 41 and a second zone 42. The embryonic web encounters, in order, the first zone 41, then the second zone 42, then subsequent zone(s), if any. The first zone 41 is maintained at a pressure less than the breakthrough pressure of the apparatus 20. The second zone 42 is maintained at a pressure greater than the breakthrough pressure of the apparatus 20. The breakthrough pressure is found according to the Society of Automotive Engineers' Aerospace Recommended Practice 901 issued Mar. 1, 1968, and entitled Bubble Point Test Method, and modified to use a 50 millimeter immersion depth, and which Practice is incorporated herein by reference.

Collectively, the first and second zones 41, 42 may subtend an arc from about 180 to 270 degrees, more preferably 210 to 240 degrees. The first zone 41 may comprise up to 60 degrees of the total arc subtended by the first and second zones 41, 42 and more preferably 20 to 30 degrees.

The support member 28 transports the absorbent embryonic web relative to the apparatus 20 and across the zones 41, 42 at a rate providing the embryonic web a residence time in the first zone 41 of less than 35 milliseconds, preferably less than 25 milliseconds, more preferably less than 15 milliseconds. The residence time in the second zone 42 should be at least 125 and preferably at least 175 milliseconds.

As used herein, an "absorbent embryonic web" comprises a cellulosic fibrous structure, or any other web which is deposited wet and must have the water removed to be in a dry state to be functional. As used herein, a web is considered "absorbent" if it can hold and retain water, or remove water from a surface. As used herein, "cellulosic fibrous structures" refer to structures, such as paper, comprising at least fifty percent cellulosic fibers, and a balance of synthetic fibers, organic fillers, inorganic fillers, foams etc. Suitable cellulosic fibrous structures for use with the present invention can be found in commonly assigned U.S. Pat. No. 5,245,025 issued Sep. 14, 1993 to Trokhan et al., which patent is incorporated herein by reference.

Figure 2:
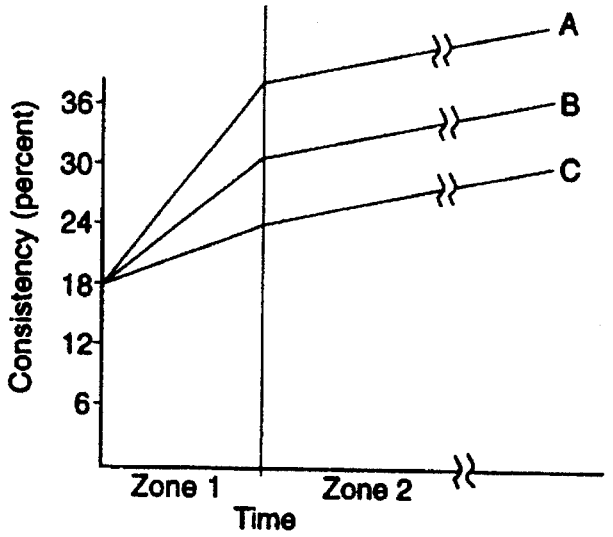
FIG. 2 is a graphical representation of relationship between consistency and residence time on an apparatus according to the present invention.

By providing two distinct zones 41, 42, the first zone 41 having a pressure less than the breakthrough pressure of the limiting drying orifice apparatus 20, and the second zone 42 having a pressure greater than the break-through pressure at the aforementioned residence times, it has been found that the fan horsepower necessary to provide the differential pressure can be substantially reduced. Applicants have unexpectedly found that further drying, and hence increases in consistency, do not substantially increase after more than the aforementioned residence times in the first zone 41 occur, as illustrated by FIG. 2.

By properly selecting the residence time in the first zone 41, then transferring the embryonic web to the second zone 42, the efficiency of the drying process can be maximized and the fan horsepower reduced. For the invention described and claimed herein, the apparatus 20 has a water removal rate in the second zone 42 of at least 5, and preferably at least 7, pounds of water per pound of embryonic web per second.

The proper transition point between the first and second zones 41, 42 is that point at which the water removal rate of the second zone 42 exceeds the water removal rate of the first zone 41. The actual transition point is where the differential pressure through the apparatus 20, relative to atmospheric, goes from less than the breakthrough pressure to greater than the breakthrough pressure. The system is optimized when the actual and the proper transition points are coincident. It is recognized that the exact transition point will depend upon the porosity and drainage capabilities of the absorbent embryonic web, the flow characteristics and size of the orifices in the micropore medium, and perhaps other factors as well.

The second zone 42 may be partitioned into one or more subzones, each having a dedicated fan or may be maintained without a partition and have a single large fan as desired. Alternatively, a single zone 41 or 42 may have its differential pressure generated by two or more fans. The fans may be arranged in series or in parallel. It is generally believed that the horsepower requirements of two smaller fans or one larger fan, having the same total horsepower, are very similar as used in conjunction with the present invention.

Since the first zone 41 is run at less than breakthrough pressure, it does not require a ran and may work well with a vacuum pump. Thus, the first zone 41 consumes only minimal energy in the apparatus 20 according to the claimed invention. As used herein, the unit horsepower refers only to the horsepower necessary to create the differential pressure in the apparatus 20, and does not include horsepower necessary to transport the embryonic web relative to the apparatus 20.

For the invention described and claimed herein, the ratio of the drying rate of the second zone 42 to the drying rate of the first zone 41, as measured in pounds of water per pound of embryonic web per second per unit horsepower, is at least 0.10 times as great, and preferably at least 0.12 times as great. Of course this ratio can be artificially inflated by running an inefficient first zone 41. For purposes of the present invention the first zone has a water removal rate of at least 40 pounds of water per pound of embryonic web per second. There is minimal horsepower involved in the water removal rate of the first zone 41, since the first zone 41 relies upon capillary dewatering which occurs below the breakthrough pressure, and does not rely upon a ran to create airflow above the breakthrough pressure.

The aforementioned residence times are useful for an embryonic web having a pulp filtration resistance (PFR) of 5 to 20, and preferably from 10 to 11. Pulp filtration resistance is measured according to the procedure set forth in commonly assigned U.S. Pat. No. 5,228,954 issued Jul. 20, 1993 to Vinson et al., which patent is incorporated herein by reference.

Referring to FIG. 2, it is to be recognized that the drying rate in the first zone 41 varies according to PFR. The drying rate in the second zone 42 is the same for all three curves A, B and C. Curves A, B and C in FIG. 2 show, in order, increasing PFR.

Generally, it has been found that the optimum residence time on the apparatus 20 is directly proportional to the pulp filtration resistance. The incoming embryonic web has a consistency of at least 18 percent, and possibly at least 19 percent.

The apparatus 20 according to the present invention has a greater water removal capability for a given PFR than is obtainable with prior an porous cylinders which dry the web by capillary attraction and are maintained at less than breakthrough, as illustrated in commonly assigned U.S. Pat. No. 4,556,450 issued Dec. 3, 1985 to Chuang et al., the disclosure of which is incorporated herein by reference, prior art woven support members 28, and prior art photosensitive resin support members 28.

Water removal rate is measured in terms of pounds of water removed per pound of fiber divided by the time the fibers are subjected to the process rate=(pounds of water removed/pounds of fiber)/time in seconds The water removal rate is ascertained by measuring the consistencies of the embryonic web before and after the zone 41, 42 in question using gravimetric weighing and convective drying to achieve a bone-dry baseline. The residence time can be easily calculated knowing the path length of the zone 41, 42 and the velocity of the embryonic web.

Figure 3:
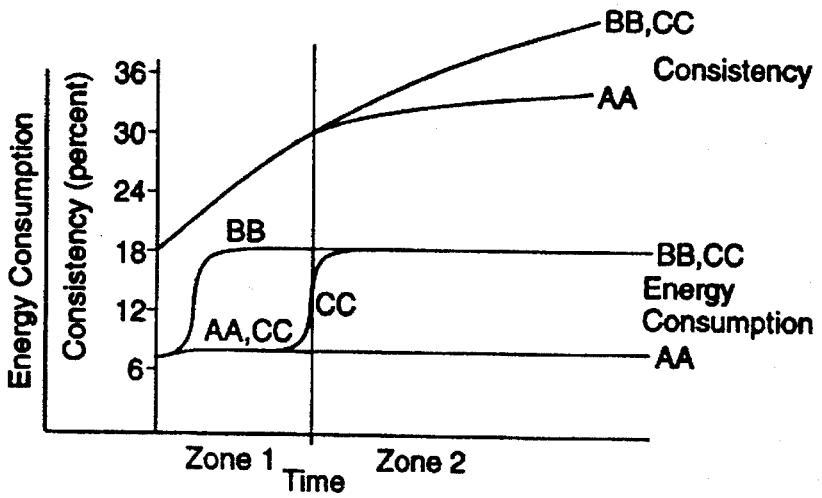
FIG. 3 is a graphical representation of energy consumption and water removal as a function of time for the present invention (CC), a prior art micropore medium drying apparatus (BB) and a prior art apparatus made according to commonly assigned U.S. Pat. No. 4,556,450 issued Dec. 3, 1985 to Chuang et al. (AA).

Referring to FIG. 3, one will note that the water removal rate in zone 2 is considerably higher in the apparatus according to the present invention than is the water removal rate from the cylinder made according to the aforementioned Chuang et al. patent The apparatus 20 according to the present invention has a water removal rate of at least 5pounds of water per pound of embryonic web per second, and more preferably at least 7 pounds of water per pound of embryonic web per second in the second zone 42. The apparatus 20 according to the present invention has a water removal rate of at least 40 pounds of water per pound of embryonic web per second, and more preferably at least 50 pounds of water per pound of embryonic web per second in the first zone 41.

The apparatus 20 according to the present invention has a power consumption or less than 5, and preferably less than 4 horsepower per square foot of web area subjected to the process in the first zone 41. The apparatus 20 according to the present invention has a power consumption or less than 20, preferably less than 18, and more preferably less than 16 horsepower per square root of web area subjected to the process in the second zone 41.

What is claimed is:

1. A limiting orifice though-air-drying papermaking apparatus in combination with an absorbent embryonic web having moisture distributed therein, said apparatus comprising a limiting orifice for airflow through said embryonic web, wherein said apparatus further comprises a plurality of distinct zones, comprising, in order, at least a first zone and a second zone, said distinct zones having mutually different differential pressures relative to the atmospheric pressure, and having means to enable said embryonic web to have a residence time on said first zone of less than about 35 milliseconds.

2. An apparatus according to claim 1, wherein said residence time is less than 25 milliseconds.

3. An apparatus according to claim 2, wherein said residence time is less than 15 milliseconds.

4. An apparatus according to claim 1, wherein said plurality of zones comprises two zones, a first zone and a second zone.

5. An apparatus according to claim 4, wherein said first zone has a differential pressure less than the break-through pressure of said apparatus.

6. An apparatus according to claim 5, wherein said second zone has a differential pressure greater than the break-through pressure of said apparatus.

7. An apparatus according to claim 4, wherein said first zone consumes less than 5 horsepower per square foot.

8. An apparatus according to claim 7 wherein said apparatus has a power consumption of less than 7 horsepower per square foot of embryonic web in said first zone.

9. An apparatus according to claim 7 wherein said apparatus has a power consumption of less than 20 horsepower per square foot of embryonic web in said second zone.

10. An apparatus according to claim 9 wherein said apparatus has a power consumption of less than 18 horsepower per square foot of embryonic web in said second zone.

11. An apparatus according to claim 10 wherein said apparatus has a power consumption of less than 16 horsepower per square foot of embryonic web in said second zone.

12. An apparatus according to claim 1, wherein said embryonic web comprises a cellulosic fibrous structure having a pulp filtration resistance of 10 to 11.

* * * * *

UNITED STATES PATENT AND TRADEMARK OFFICE

CERTIFICATE OF CORRECTION

PATENT NO. : 5,625,961

DATED : May 6, 1997

INVENTOR(S) : DONALD E. ENSIGN ET AL.

It is certified that error appears in the above-indentified patent and that said Letters Patent is hereby corrected as shown below:

Title page of the issued patent, under References Cited, U.S. PATENT DOCUMENTS, insert the following: --

| | | | |
|---|---|---|---|
| 3,65,559 | 8/66 | Means | 162/276 |
| 4,074,441 | 2/78 | Helversen et al. | 34/122 --; |

and under FOREIGN PATENT DOCUMENTS, insert --

| | | |
|---|---|---|
| 0115172 | 8/84 | Europe |
| WO 94/00636 | 1/94 | PCT --. |

Column 1, line 61, "an" should read -- art --.

Column 1, line 64, "at." should read -- al. --.

Column 2, line 24, "or" should read -- of --.

Column 3, line 10, "bell" should read -- belt --.

Column 3, line 16, "an" should read -- art --.

Column 3, line 19, "an" should read -- art --.

Column 5, line 32, "break-through" should read -- breakthrough --.

Column 6, line 24, "ran" should read -- fan --.

Column 6, line 46, "an" should read -- art --.

Column 7, line 13, "or" should read -- of --.

Column 7, line 16, "or" should read -- of --.

Column 7, line 18, "root" should read -- foot --.

UNITED STATES PATENT AND TRADEMARK OFFICE

CERTIFICATE OF CORRECTION

PATENT NO. : 5,625,961

DATED : May 6, 1997

INVENTOR(S) : DONALD E. ENSIGN ET AL.

It is certified that error appears in the above-indentified patent and that said Letters Patent is hereby corrected as shown below:

Column 8, line 2, claim 5, "break-through" should read --breakthrough--.

Signed and Sealed this

Thirtieth Day of September, 1997

*Attest:*

*Attesting Officer*

BRUCE LEHMAN

*Commissioner of Patents and Trademarks*